United States Patent [19]

Herrnring

[11] Patent Number: 4,573,819

[45] Date of Patent: Mar. 4, 1986

[54] SYSTEM FOR SUPPLYING INK FOR WRITING INSTRUMENTS

[75] Inventor: Günther Herrnring, Alvesloe, Fed. Rep. of Germany

[73] Assignee: Montblanc-Simplo GmbH, Hamburg, Fed. Rep. of Germany

[21] Appl. No.: 500,257

[22] Filed: Jun. 2, 1983

[30] Foreign Application Priority Data

Jun. 2, 1982 [DE] Fed. Rep. of Germany ..... 3220750

[51] Int. Cl.[4] ..... B43K 5/00; B43K 5/08; B43K 5/18; B43K 5/10

[52] U.S. Cl. ..... 401/151; 401/190; 401/194; 401/195

[58] Field of Search ..... 401/151, 194, 195, 190

[56] References Cited

U.S. PATENT DOCUMENTS

| | | | |
|---|---|---|---|
| 1,428,079 | 9/1922 | Clark | 401/151 |
| 2,222,824 | 11/1940 | Rossier | 401/65 |
| 2,509,465 | 5/1950 | Wing | 401/151 |
| 2,567,618 | 9/1951 | Quaintance | 401/151 |
| 4,015,269 | 3/1977 | Edo | 401/194 X |
| 4,318,626 | 3/1982 | Bok | 401/151 |
| 4,350,458 | 9/1982 | Murahara et al. | 401/151 X |
| 4,360,280 | 11/1982 | Sekiguchi et al. | 401/194 |

FOREIGN PATENT DOCUMENTS

| | | | |
|---|---|---|---|
| 1428502 | 9/1972 | United Kingdom | 401/190 |

*Primary Examiner*—Steven A. Bratlie
*Attorney, Agent, or Firm*—Becker & Becker, Inc.

[57] ABSTRACT

An ink supply system for writing instruments which operate with liquid ink or writing fluid. In order to make uniform the supply of ink or writing fluid independent of environmental influences, and to make possible a longer writing time with one filling, it is proposed to first store the writing fluid in a primary, permanently compressible, non-capillary and large-volume supply chamber. From this primary supply chamber, a small-volume, capillary secondary supply chamber, which communicates with the writing element, is supplied via an auxiliary charging valve which is controllable as a function of need for ink or writing fluid. The filling of the secondary supply chamber can be detected with a sensor, and the auxiliary charging valve can be controlled.

9 Claims, 29 Drawing Figures

SYSTEM FOR SUPPLYING INK FOR WRITING INSTRUMENTS

BACKGROUND OF THE INVENTION

The present invention relates to a system for supplying ink or writing fluid for writing instruments which operate with liquid ink or writing fluid.

With pens for writing fluid or liquid ink, it is customary to utilize the adhering ink or writing fluid level as the functional physical principle. Due to gas principles, this technical solution is extremely sensitive to fluctuations in temperature and air pressure. For modern types of hand-held writing instruments, such as felt-tip pens, ink ball-point pens, and similar instruments, there is provided a capillary retaining means of the ink or writing liquid by means of fibrous members, also known as plugs or wicks. This system is sufficiently insensitive to variations in temperature and air pressure, but provides a nonuniform writing fluid or liquid ink flow since the capillary cross-sectional areas differ. Not only does the average value fluctuate, but also the distribution of the capillary potentials fluctuates from one wick to another, and even the capillary potentials within a given wick show a wide spread. The latter also leads to only partial absorption of the writing fluid or liquid ink through the writing element. Furthermore, the material of the fiber member displaces a considerable amount of space, about 50 percent, which cannot be filled with writing fluid or liquid ink.

It is an object of the present invention to provide storage for writing fluid or liquid ink for hand-held writing instruments which, largely uninfluenced by climatic changes, allows a uniform supply of writing liquid or ink to the writing element and also allows one to write with a pen as long as possible on a single filling. The latter is to be achieved not only by means of a large holding capacity, but also with a high color intensity of the writing liquid or ink. The higher concentration of color as, for example, pen ink or writing liquid customarily also leads to a higher viscosity. Such higher viscosity inks or writing liquids cannot be used with writing instruments which operate pursuant to the aforementioned principle of the adhering level.

BRIEF DESCRIPTION OF THE DRAWINGS

These objects, and other objects and advantages of the present invention, will appear more clearly from the following specification in conjunction with the accompanying drawings, in which.

SUMMARY OF THE INVENTION

Figure 1:
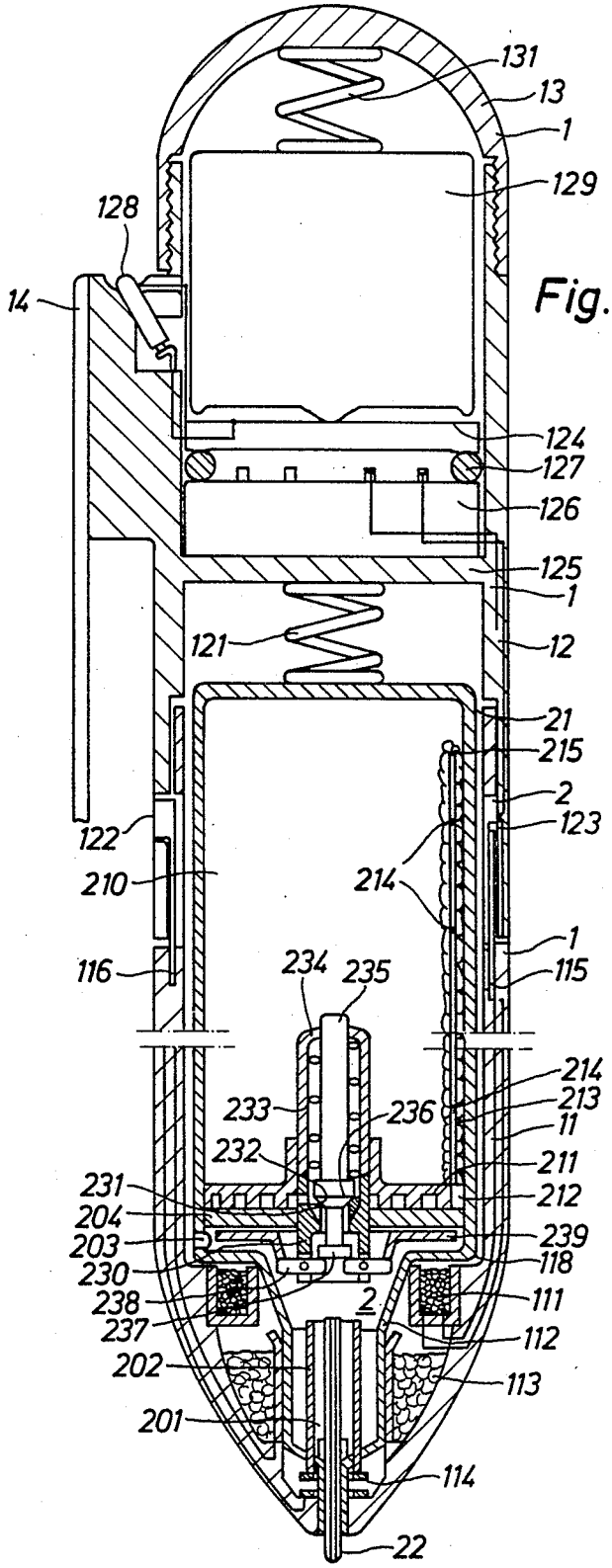
FIG. 1 is an axial section through one inventive embodiment of a writing instrument.

The ink, writing fluid or liquid supply system of the present invention is characterized primarily in that for the writing fluid there is provided a primary, non-capillary, large-volume reservoir which can be permanently compressed, and a secondary, small-volume reservoir which communicates with the atmosphere or outer air and also communicates with the writing element; and in that the primary and secondary reservoirs communicates with one another by means of an auxiliary charging valve which can be controlled as a function of need. (see FIG. 16)

Preferably, sensors which are responsive to the filling of the secondary reservoir serve for the control of the auxiliary charging valve. A manual actuation is also possible.

Pursuant to conceivable specific features of the present invention, an indicator which signals the ink filling, and a manually operable actuating element for the auxiliary charging valve, may be provided.

A sensor may be provided which is responsive to the ink filling of the secondary reservoir and which, via a controller which is energized from a voltaic cell, acts on an electromagnetic actuating device of the auxiliary charging valve. This sensor may be capacitive sensor in the form of a capacitor, the electrodes of which are electrically separated from one another and are arranged on both sides of an ink-filled gap of the capillary secondary reservoir. One of the capacitor electrodes may be formed by a tube which is associated with the writing element. At that end of the ink writing instrument which is remote from the writing element, a plate-like controller, which is adapted to the cross-section of the instrument and which has a primary source of power, may be arranged, with the controller controlling the auxiliary charging valve as a function of the signals coming from the sensor. The controller may be formed by an IC or integrated circuit element.

The writing instrument may include a multi-part housing which can be taken apart in the axial direction; cooperating pairs of contacts may be provided as connecting lines between the sensor and auxiliary charging valve on the one hand, and the controller and source of power on the other hand, with the contacts extending to the separating plane of the housing of the writing instrument. The pairs of contacts may be asymmetrically arranged relative to the separating plane of the housing of the writing instrument.

The auxiliary charging valve may comprise an annular valve seat which is arranged coaxially behind the writing element, and a valve push rod which is prestressed in the closing direction and on which radially directed actuating elements act. Portions of the auxiliary charging valve may project into the interior of the primary ink or writing fluid supply chamber.

A concentrically aligned annular horseshoe magnet may be provided in the vicinity of the writing tip or nib for actuating the auxiliary charging valve; a ferromagnetic annular disc is disposed in the magnetic field of this magnet, and is mechanically operatively connected with the push rod of the auxiliary charging valve. The ferromagnetic annular disc may act on the push rod of the auxiliary charging valve by means of radially directed, two-armed levers.

The primary ink or writing fluid supply chamber, above the ink or writing fluid content, may include a gas pressure chamber, the gas content of which is compatible with the ink or writing fluid and is immiscible with the fluid. On the outlet of the primary ink or writing fluid supply chamber on the side of the valve, a semipermeable separating wall may be arranged which does not hinder the passage of ink or writing fluid but holds back the gas. The semipermeable separating wall may have a large surface area and may be formed from woven fabric which absorbs ink or writing fluid.

In the primary ink or writing fluid supply chamber, next to a chamber which accommodate the ink or writing fluid content, a chamber filled with pressurized gas may be provided; these two chambers may be separated from one another by a sealingly inserted piston element.

The primary ink or writing fluid supply chamber may be formed by a bag or bellows which is under mechanical pressure.

The pressure in the primary ink or writing fluid supply receptacle may be the hydrostatic pressure of the ink or writing fluid, and the primary ink or writing fluid supply receptacle may be provided with a venting opening which leads to the atmosphere. The venting opening may be provided with a shutoff valve which can be actuated synchronously with the auxiliary charging valve.

In connection with the controller, which is energized by a voltaic cell, an indicator may be provided which is visible from the outside of the writing instrument; as a function of the controlled opening time of the auxiliary charging valve, the indicator signals the depletion of the supply of ink or writing fluid in the primary ink supply receptacle.

The valve body of the auxiliary charging valve may be the rotor of an electric motor and may cooperate with a coaxially disposed valve seat, with the valve body being provided with a recess which communicates with the large-volume ink or writing fluid supply chamber, while the valve seat is provided with a channel which communicates with the small-volume ink or writing fluid supply chamber. The valve body may be a part of the permanent magnetic rotor which is disposed within the ink space or writing fluid chamber; externally of the ink or writing fluid chamber space, an electromagnetic induction winding is provided which surrounds the permanent magnetic rotor and the ink or writing fluid housing. The valve body may have the shape of a cone, with its front end face being hollowed out over a limited angle; the associated valve seat may also be conical, and may be provided with a valve discharge bore which is displaced radially outwardly. The rotary auxiliary charging valve may be arranged within the connection bore of the ink or writing fluid cartridge and may be pressed into its seat by pressure within the ink cartridge. The rotary auxiliary charging valve may be provided with a spring which presses the valve body against the valve seat surface.

The auxiliary charging valve may be axially movable, and may be actuated by an electric motor via a circumferential roller conveyor or curve drive which moves the valve body back and forth in the axial direction relative to the valve seat during a single rotation of the motor shaft. Steel capillary tubes which extend helically in the housing of the writing instrument may serve for supplying the auxiliary charging valve; the valve body may be pressed into is valve seat by means of these steel capillary tubes in the manner of compression springs.

The non-capillary, large-volume ink or writing fluid supply chamber may be closed off by a ball valve, the ball of which is held in its valve seat by means of the pressure which exists in the cartridge; at a slight distance from the valve seat, an abutment may be provided which does not hinder the passage of ink or writing fluid and which, in the opened state, holds the valve ball in the vicinity of its valve seat. The valve seat may be yielding in order, when the valve is closed, to hold the valve ball tightly and positively.

DESCRIPTION OF THE PREFERRED EMBODIMENTS

Referring now to the drawings in detail, hand-held writing instruments customarily comprise a generally tubular housing which surrounds the functional parts. Especially two types of functional parts have gained acceptance in the market place:

1. For writing elements having a long working life, for example pen nibs or capillary tubes, the ink or writing fluid cartridge has a small insertable ink or writing fluid bottle, and the supply mechanism and writing element as components of the housing; and
2. For writing elements having a short working life, such as ball-point pens, felt tip pens, and the like, the refill which is replaceable as inserted in the receptacle, and includes the writing element and the writing medium.

Inventive technical solutions for these two possibilities are taken into consideration by the aforementioned drawings and the subsequent description.

Figure 3:
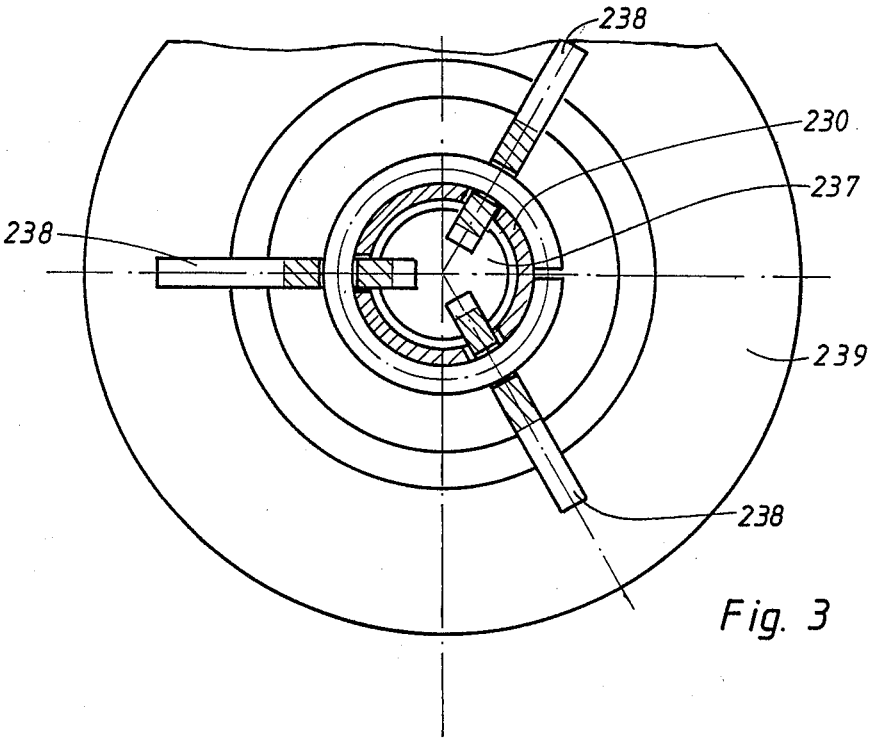
FIG. 3 is a section taken along the line III—III in FIG. 2.
Figure 2:
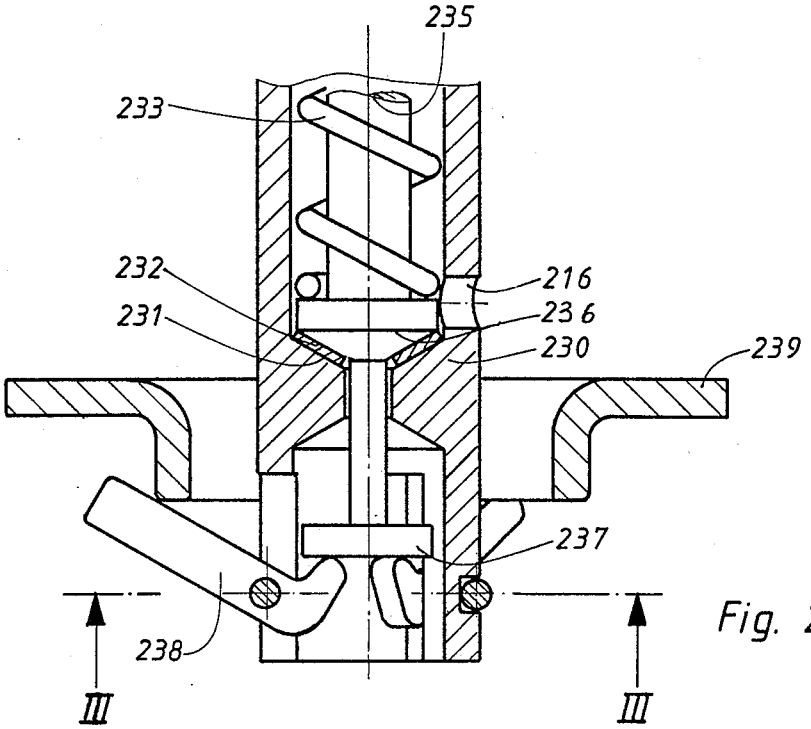
FIG. 2 in larger scale shows a detail of FIG. 1.
Figure 4:
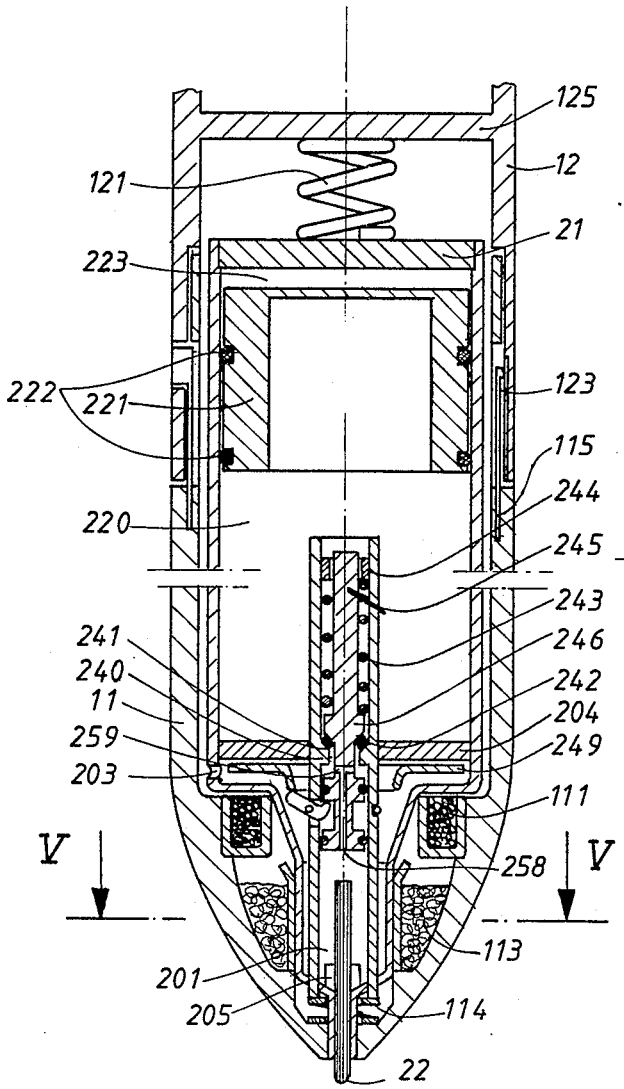
FIG. 4 is an axial section through the front portion of another inventive embodiment of a writing instrument.
Figure 5:
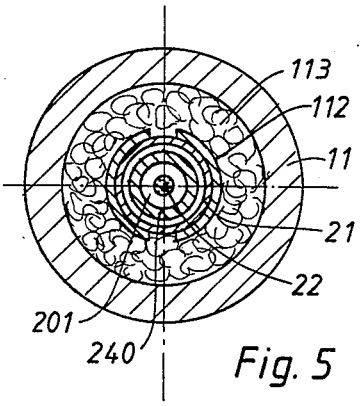
FIG. 5 is a section taken along the line V—V in FIG. 4.

FIGS. 1–3 show a writing instrument having a refill. The receptacle 1 comprises the front part 11, the middle part 12, and the head 13. The clip 14 is fastened to the middle part 12. The refill 2 is replaceable as inserted into the receptacle 1, and comprises the rigid housing 21, which will subsequently also be referred to as the primary supply chamber, and the point or nib 22. The nib 22 can, for example, be a synthetic capillary point, a felt tip, or a ball-point nib. The refill 2 is pressed by a compression spring 121 against the stop 118 in the front part 11 of the housing. The nib 22 extends into the capillary chamber 201 of the refill, which chamber will subsequently also be referred to as the secondary supply chamber and is divided by concentric synthetic cylinders which communicate with one another and between their walls form cylindrical capillaries having a thickness of preferably 0.1–0.2 mm. These cylinders are not illustrated in the drawing since such capillary bodies, as well as capillary bodies rolled with spacing and capillary bodies comprising discs which are disposed at right angles to the axis and have a capillary spacing, are known. Only the outer cylinder 202 is illustrated which comprises an electrically conductive material, for example austenitic steel, and which forms a part of the capacitive sensor which will be described subsequently. This cylinder 202 is guided through the refill housing 21 with an electrical connection in a liquid-sealed manner, and forms with the housing wall 21 a capillary gap, the ink or writing fluid filling height of which is measured. The overall capillary chamber is connected with the atmosphere by means of the opening 203.

A separating wall 204, which is gas tight and liquid tight, divides the refill into the small-volume secondary capillary chamber 201, and the large-volume primary ink or writing fluid supply chamber 210 which is under pressure. An auxiliary charging valve 230 is sealingly placed in the wall 204. This valve 230 includes a valve seat 231 on which a sealing ring washer or gasket 232 is placed. The spring 233, which rests against a cap 234, presses the valve disc 236 of the push rod 235 sealingly against the valve seat 231 and the gasket 232.

That end of the push rod 235 which projects into the capillary chamber 201 is provided with an abutment plate 237 for levers 238 which are actuated by the ferromagnetic donut disc plate 239 and an electromagnet 111 in the receptacle end 11.

Supply of ink or writing fluid from the chamber 210 to the valve seat 231 is effected by a capillary Archimedean spiral which is formed in a groove manner in the underside of a synthetic bottom plate 211. The grooved ends at the wall of the refill housing in the opening 212, in which there is placed sealingly a capillary tube 213 which is open toward the top and is provided with side openings 214. An absorbent mantle 215, for example of woven fabric, closed on all sides, is placed upside-down over this capillary tube.

The primary chamber 210 is filled with ink or writing fluid and with a propellant which is immiscible with ink or writing fluid, for example isobutane or a fluorohydrocarbon. Already the first time that the refill is filled, the mantle 215 becomes completely absorbed with ink or writing fluid and, as a semipermeable membrane, prevents the penetration of gaseous propellant into the capillary tube. FIG. 2 shows the ending of the capillary tube 213 at the opening 216 at the valve end.

The annular horseshoe-electromagnet 111 rests in the end 11 of the receptacle. This construction makes it possible to keep the gap between the ferromagnetic plate 239 and the electromagnet 111 as small as possible.

High-quality steel half shells 112, which are yieldingly supported with a foam rubber ring 113 between the end 11 of the receptacle and the wall of the refill which in this region is not conductive, with the cylinder 202 form the capacitor plate pair in the refill. Fastened to the bottom of the end 11 of the receptacle there is a spring contact 114 for the inner capacitor plate, i.e. the cylinder 202. The spring contact 114, the capacitor plate 202, and the electromagnet 111 are electrically conductively connected with contact springs or pins 115. The contacts 115 establish the connection between the writing element with a sensor in the front part of the writing instrument, and the electrical components (source of power, control switch) which are arranged in the back part of the writing instrument. The end 11 of the receptacle is mechanically connected with the middle part 12 of the writing instrument by means of a pin closure, for example by means of the pins 116 which lock in the recesses 122 in the receptacle. An asymmetrical arrangement of these pins 116 assures that no misconnections of the contacts 115 with the cooperating contacts 123 which are arranged in the back part of the writing instrument occur. The recesses 122 in the receptacle also serve for venting the receptacle chamber. This is important for the functioning of embodiments such as that illustrated in FIG. 10 and those which utilize refills and cartridges and operate with an ink or writing fluid chamber which can be mechanically compressed.

The cooperating contacts 123 are electrically conductively connected with a plate 124 which is located in the upper chamber of the middle part 12 of the writing instrument, which chamber is divided by the separating wall 125. The plate 124 is equipped with all of the electrical connections outside of the IC or integrated circuit housing 126. The IC or integrated circuit housing 126 and the plate 124 are held by the clampling ring 127. The optical or audible signal element 128 signals when the refill 2 no longer contains any ink or if the source of power 129 in the back part of the writing instrument no longer delivers sufficient power. Contact is maintained with the battery or cell 129 by means of the plate 124 and the spring 131 which is located in the back end of the writing instrument.

Figure 16:
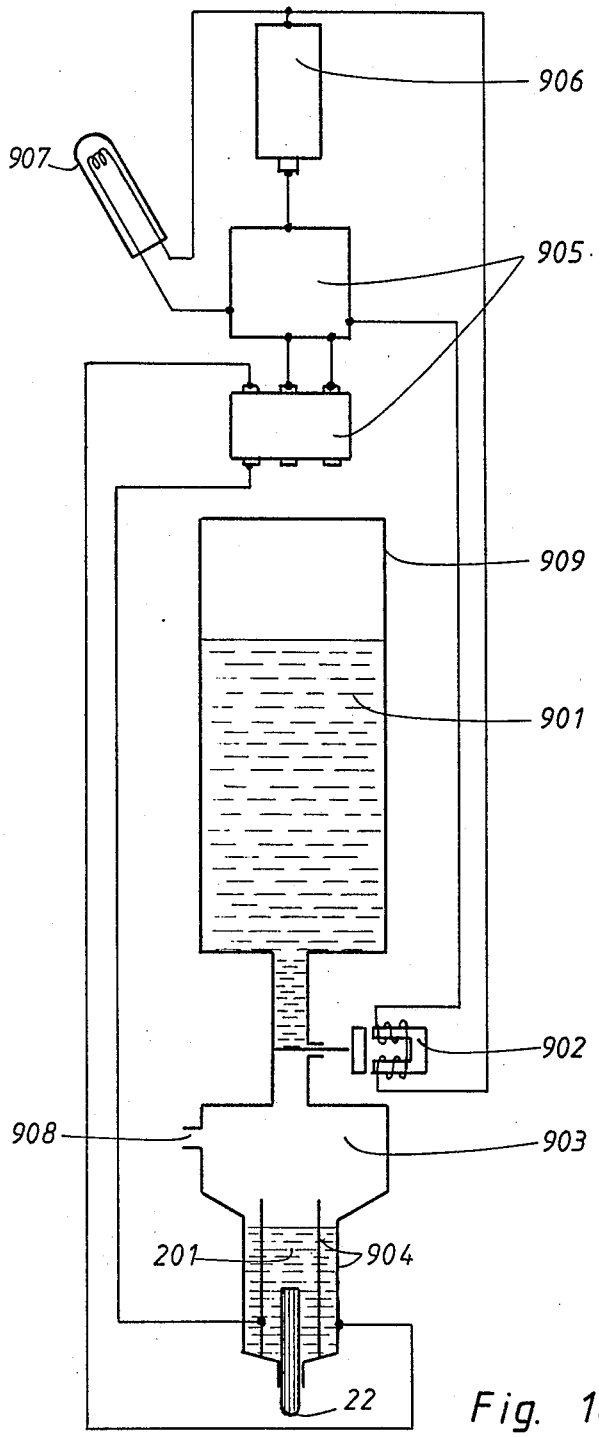
FIG. 16 is a basic circuit diagram for the electrical control of the auxiliary charging valve provided for the inventive writing instruments.

The principle of the foregoing inventive hand-held writing instrument, which was described with the aid of FIGS. 1–3, and also of the writing instruments which will be described subsequently, is schematically illustrated in FIG. 16.

The writing fluid 901, which is located under pressure in the primary reservoir 21, is measured out as needed into the front capillary chamber 903, i.e. the secondary reservoir 201, by a valve 202, i.e. the auxiliary charging valve 230 in FIG. 1, which is closed by a spring and/or the pressure exerted on the ink or writing fluid. The measuring out is effected by means of a sensor 904, i.e. the capacitor 112-202, the capacitance of which is a function of the filling of the secondary reservoir 201. The sensor 904 detects the ink or writing fluid filling of the secondary reservoir 201 and transmits via a control-switch mechanism 905 (in FIGS. 1, 124 and 126) the signals for opening and closing the electromagnetic valve 902. A battery or a cell 906 (in FIGS. 1, 129) delivers the electrical energy. The signal emitter 907 (in FIGS. 1, 128) for example, can be an LED or light emitting diode. 908 indicates the opening of the capillary chamber 903 to the atmosphere. This is in contrast to the closed pressure chamber 909 of the refill 2. It is also possible to get by with just one opening signal, and to effect closure by means of a timing member. This method has the drawback that the opening interval must be maintained for a short period of time in order to avoid overflow of the capillary chamber. In this connection, maximum pressure is expected. However, if only a relatively low pressure exists, for example when the supply of ink in the cartridge or refill is nearly used up, the pump strokes accumulate and the valve can flutter.

By way of example, a capacitive sensor can be used having a design in which a quantitative measurement of the filling volume of the capillary chamber takes place. With a cylindrical capacitor, the capacitance is given by the following formula:

$$C = \underbrace{\frac{2\pi\epsilon_o L}{\ln(D/d)}}_{C_o} + \frac{2\pi\epsilon_o}{\ln(D/d)}(\epsilon_r - 1)h$$

where $\epsilon_o$ is the absolute dielectric constant and $=0.8855\times10^{-13}$V s/A cm $\epsilon_r$ is the relative dielectric constant, with air being 1 and water being 81

Figure 17:
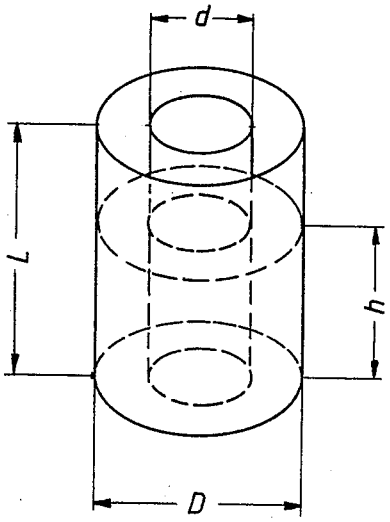
FIG. 17 is a schematic illustration to explain a capacitive sensor.

$h$ is the filling height
$L$ is the height of the cylinder
$D$ is the outer diameter
$d$ is the inner diameter
} pursuant to FIG. 17

Among the measurements of a writing instrument, the initial capacitance $C_o$ is 4–20 pF. A height of the ink of 1 mm denotes a change of the capacitance of $(8\times C_o/L)$8–80 pF.

In this case, L is 1 cm to 2 cm, and ln (D/d) is between 0.05 and 0.2.

Figure 18:
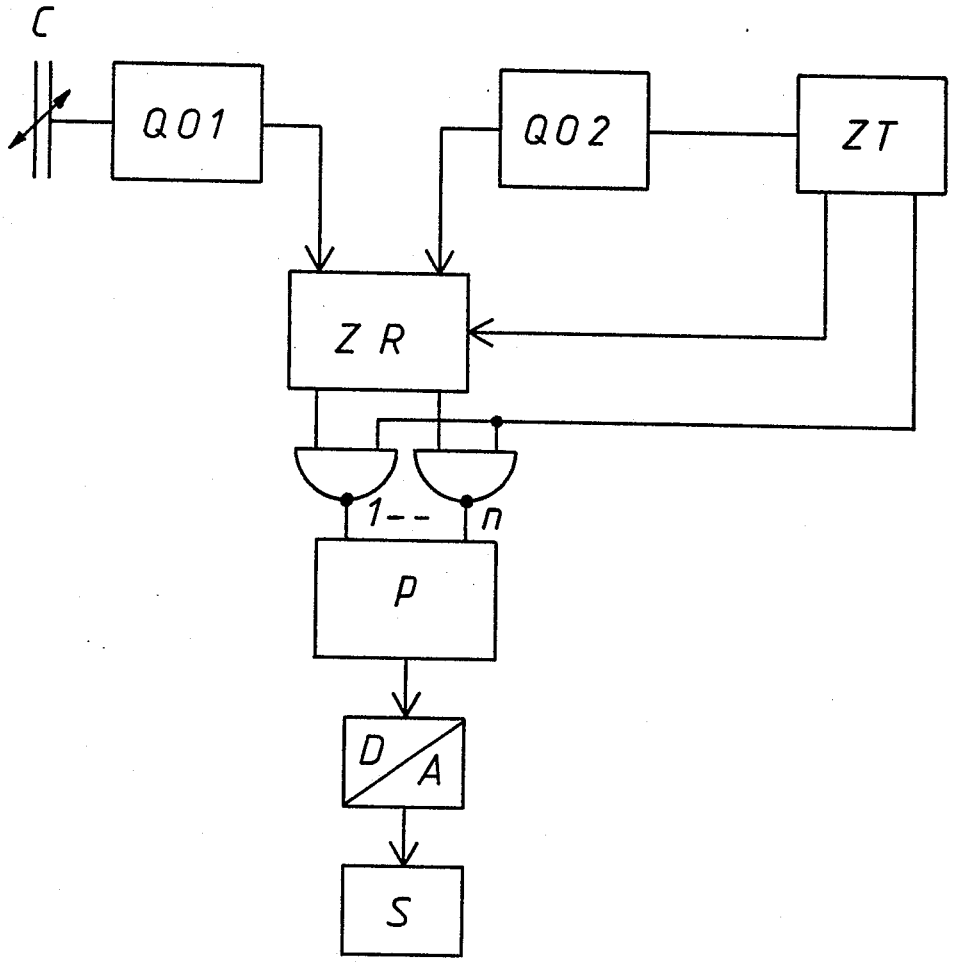
FIG. 18 is a block diagram to explain an electronic control which can be used for the inventive writing instruments.

In order to be able to reliably measure such slight changes in capacitance, a circuit such as that illustrated in FIG. 18 may be used, and the change in capacitance is digitally measured by the detuning of a resonant circuit. The capacitance C being measured, for example, can be superimposed as an additional load capacitance in series with a three-pole flexural vibrator in the crystal oscillator Q01.

At a fundamental frequency of 16384 Hz, 1 Hz corresponds to approximately 5 pF. If a clock oscillator Q02 having an exact frequency of 16384 Hz is used, and a time register ZT as a timer is used, the difference of the frequency of Q01 and Q02 can be formed in the counter register ZR, which is a reversible register having zero passage circuitry; this difference can be used as a measure of the capacitance and hence a measure of the filling of the capillary chamber with ink or writing fluid. The difference in the counter register ZR is determined in prescribed cadence signals TR and is transmitted via the gate 1 . . . n into the buffer P, where it exists in the integrated measuring intervals and , via a digital-analog converter DA, is available to the control-switch mechanism S for control of the electrovalve 902.

FIGS. 4–7 show another embodiment which uses a replaceable refill. This embodiment is modified somewhat from that of the embodiment shown in FIGS. 1–3, and uses some of the same reference numerals. With this refill, the gas chamber 223 and the ink or writing fluid chamber 220 in the primary supply receptacle are separated by the piston 221. This piston 221, which can be displaced, is pressed against the ink or writing fluid by the gas located in the chamber 223. The piston 221 is sealed relative to the wall of the refill receptacle 21 by means of O-rings 222.

The auxiliary charging valve inserted in the separating wall 204 also has a different design. The valve body 240 has a valve seat 241 and a gasket 242; that part of the valve body 240 which faces the writing end of the instrument also forms the inner capacitor surface. By means of the radial holes 259 and the central hole 258, the ink or writing fluid is forcibly conveyed to the inner capillary chamber 201, i.e. the secondary supply chamber.

Figure 7:
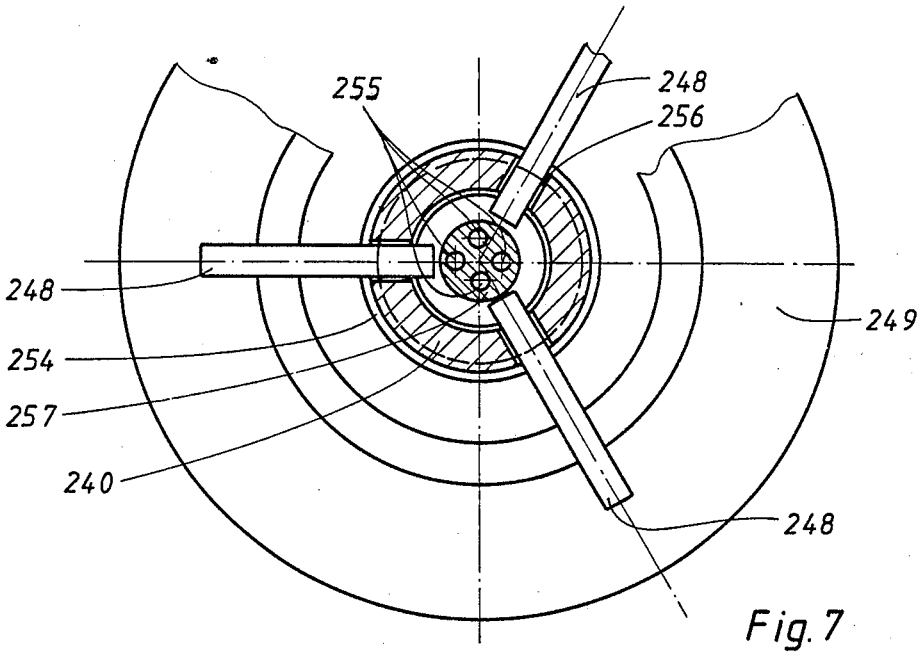
FIG. 7 is a section taken along the line VII—VII in FIG. 6.
Figure 6:
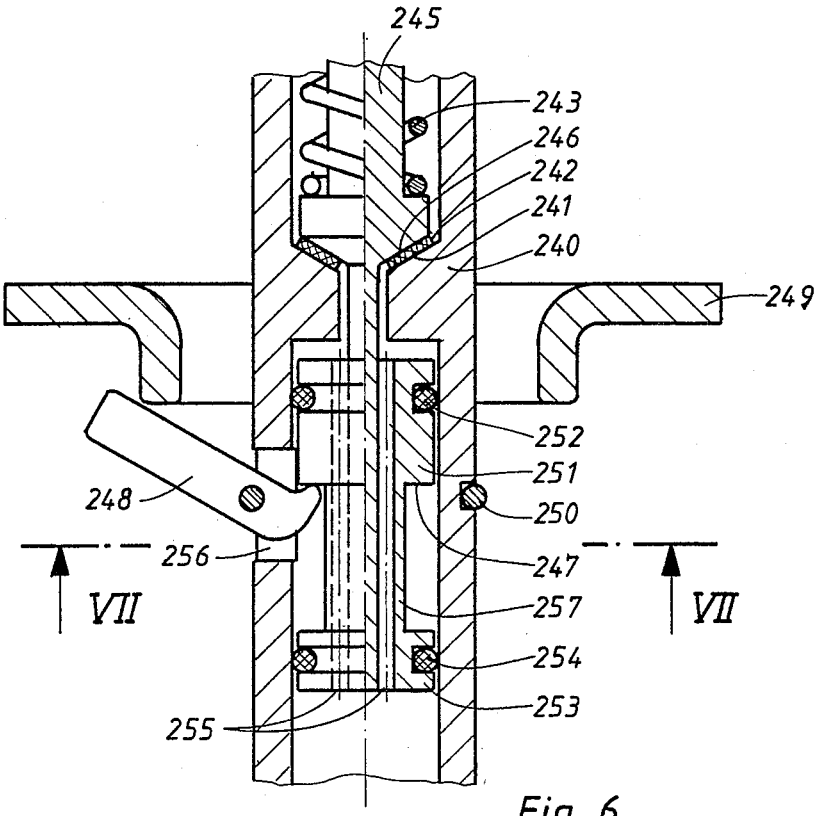
FIG. 6 in a larger scale shows a detail from FIG. 4.

So that the ink or writing fluid cannot freely exit the capillary chamber 201, as is the case with the embodiment shown in FIGS. 1–3, that part of the valve push rod 245 which is located in the capillary chamber is provided with a valve disc 246 in the form of a double piston, as shown to a larger scale in FIGS. 6 and 7. These latter figures differ from the illustration of FIG. 4 in that the angular hole 258/259 is replaced by four axial holes 255 which operate in the same way but are easier to produce.

The remaining configuration of the valve is identical to that of the originally described embodiment. The double piston 251/253 which is axially connected with the valve push rod 245 operates in the inner bore of the valve body 240 in a sealed manner by means of O-rings 252/254. Three pressure levers 248 act on the end face 247 of the piston part 251. The pressure levers 248 are rotatable on the shaft 250, and are guided in the recess 256. The spring 243 and the fluid pressure keep the valve closed as long as the levers 248 do not lift the valve disc 246. If the ferromagnetic disc 249 is pressed against the levers 248 when the electromagnet 111 is activated, the valve opens as long as the electromagnet is energized. The spring 243 is provided with a second stop ring 244. The ink or writing fluid is conveyed to the valve through capillary grooves in the stop ring 244, and through the space between the push rod 245 and the valve body 240 and the spiral spring 243.

Figures 8, 9:
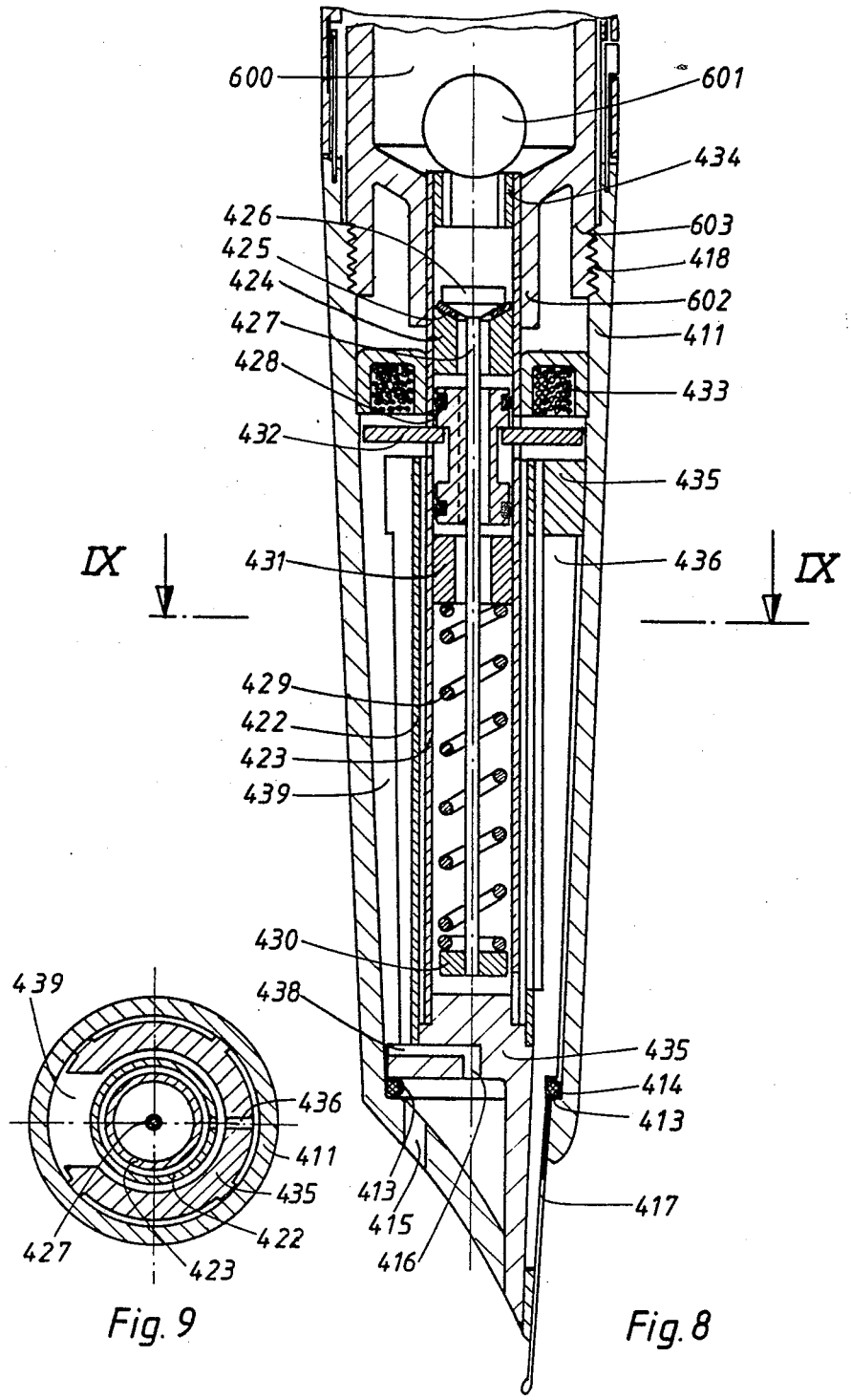
FIG. 8 is an axial section through the front part of another inventive embodiment of a fountain pen.
FIG. 9 is a section taken along the line IX—IX in FIG. 8.

FIGS. 8 and 9 show an embodiment having a writing element, for example a pen nib 417, which is fixedly inserted into the end 411 of the housing; this embodiment also has a sensor 422/423 and a valve with actuating means 424–432, as well as an ink or writing fluid cartridge 600; the sensor and the valve are also fixedly inserted in the housing. With the valve guidance illustrated in FIG. 8, the prestress spring 429 is placed in the capillary chamber. This spring rests on the one hand against the disc 430, which is rigidly connected with the push rod 427, and on the other hand against the sleeve 431, which has a tight fit in the valve housing 423. The electromagnet 433, which is protected against corrosion by being inclosed, fixes the valve housing and the inner capacitator tube 423 and forms the upper end of the end there 411 of the housing. From this end projects that part of the valve housing 423 which produces the pressure tight connection to the cartridge 600.

The end of the tube 423 is suitably designed in conformity with the configuration of the cartridge closure, for example a ball or membrane. If a ball serves as the closure of the cartridge, the tube 423 has an insert 434 having deep axial grooves so that the ink or writing fluid is not blocked when the ball is seated. So that the inner pressure does not press the ink or writing fluid cartridge 600 from its seat, the cartridge is screwed into the front part 411 by means of a threaded portion 418 in the part 11 and a thread core 603 on the neck of the cartridge. This raises the closure ball 601, and the ink or writing fluid can pass into the valve body 423 through the grooved neck 602.

Venting of the capillary chamber is effected by means of the opening 415, the prechamber 416, and the channel 438 into the chamber 439. The ink or writing fluid is conveyed to the pen nib 417 through the capillary tube 436 via the feed mechanism 435, which fixes the pen nib 417 in the front part 411. The feed mechanism 435 is sealingly placed on the abutment grooves 413 in the front part 411 by means of the O-ring 414.

Figure 10:
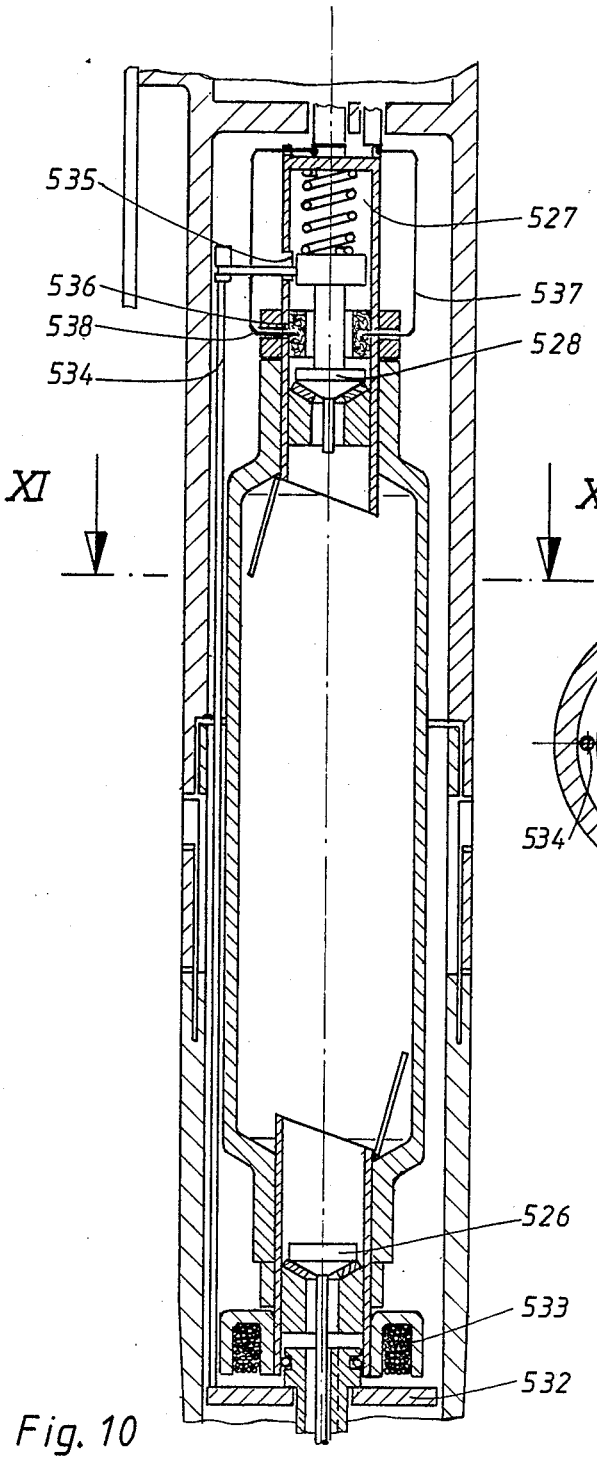
FIG. 10 is a detail of another inventive embodiment of a writing instrument which operates with an ink or writing liquid cartridge.
Figure 11:
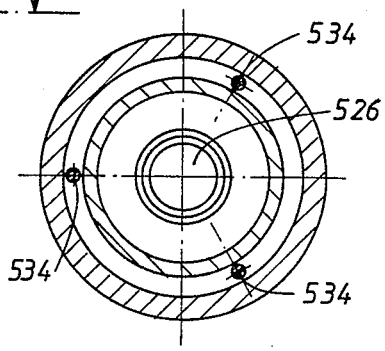
FIG. 11 is a section taken along the line XI—XI in FIG. 10.

If this system is to operate only with the hydrostatic pressure of the ink or writing fluid fluid without additional pressure, an embodiment similar to that of FIG. 10 can be used. In this case, it is necessary to provide an air pressure equalization between the inner chamber of the cartridge and the outer atmosphere during the auxiliary charging of the capillary chamber, i.e. during the time the valve 526 is open. This equalization is accomplished by means of the valve 527, the valve disc 528 of which lifts at the same time as does the valve 526 since both are controlled in common by the ferromagnetic plate 532 and the magnet 533. The plate 532 is rigidly connected with the valve 527 by means of three rods 534. The venting valve 527 is detachably connected with the three rods 534 in order to allow for replacement of the cartridge. An ink or writing fluid sensor 536, for example a small absorbent felt ring, is located behind the valve disc of the valve 527 ahead of the air openings 535. If this felt ring 536 is moistened with ink or writing fluid, that is, the writing instrument is used in that position in which its axis intersects a horizontal line and the nib point is located over the horizontal, the ink or writing fluid can discharge at the valve disc 528, arrives at the sensor, and the valves 526 and 527 are closed. This sensor, for example, can be connected as an electrical resistance which decreases when the ink or writing fluid, as an electrolyte, bridges the distance in the felt ring between two insulated contacts 537 and 538. Such a system without additional pressure, in this position above the horizontal, can be used only for writing as long as ink or writing fluid is available in the capillary chamber.

Figure 12:
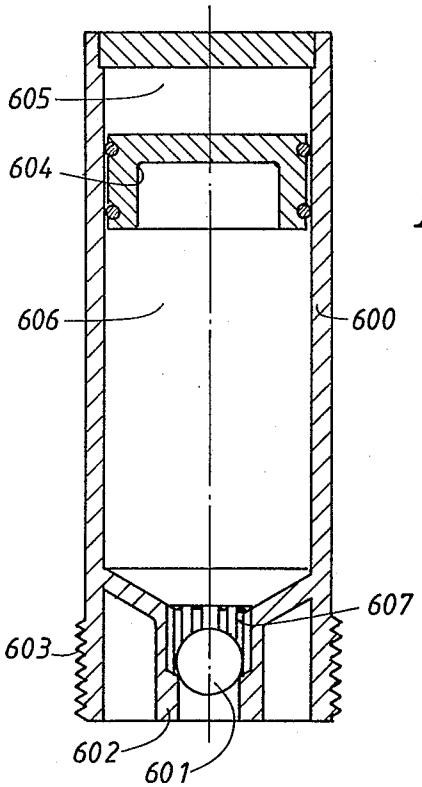
FIG. 12 is an axial section through an ink cartridge for an inventive writing instrument.

FIG. 12 shows a cartridge with a movable piston 604 which separates the propellant chamber 605 from the ink or writing fluid chamber 606. The cartridge is sealingly closed with a ball 601 in the neck 602. To insert the cartridge, the latter is screwed into the threaded part 418 (FIG. 8) of the receptacle part 411 by means of the thread 603. In so doing, the ball 601 is raised by the insert 434 of the tube 423, assuring flow of ink or writing fluid through the grooves 607 in the neck 602.

Figure 15:
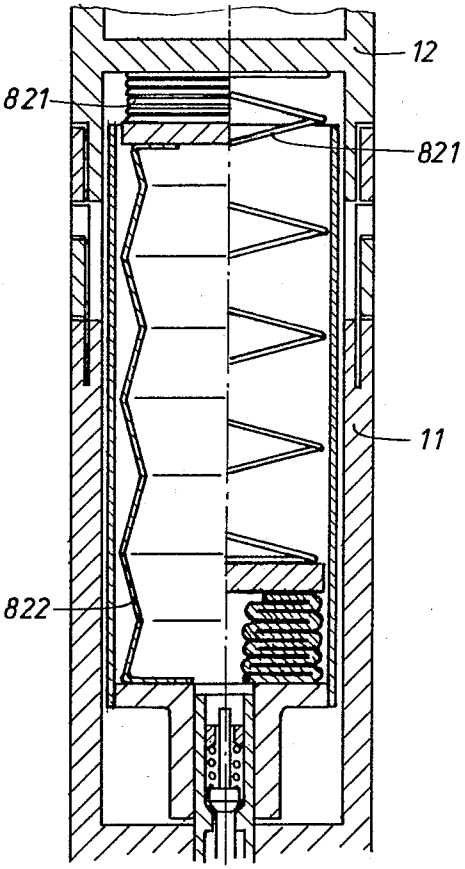
FIG. 15 is a modification of the ink cartridges illustrated in FIGS. 12 and 13.
Figure 13:
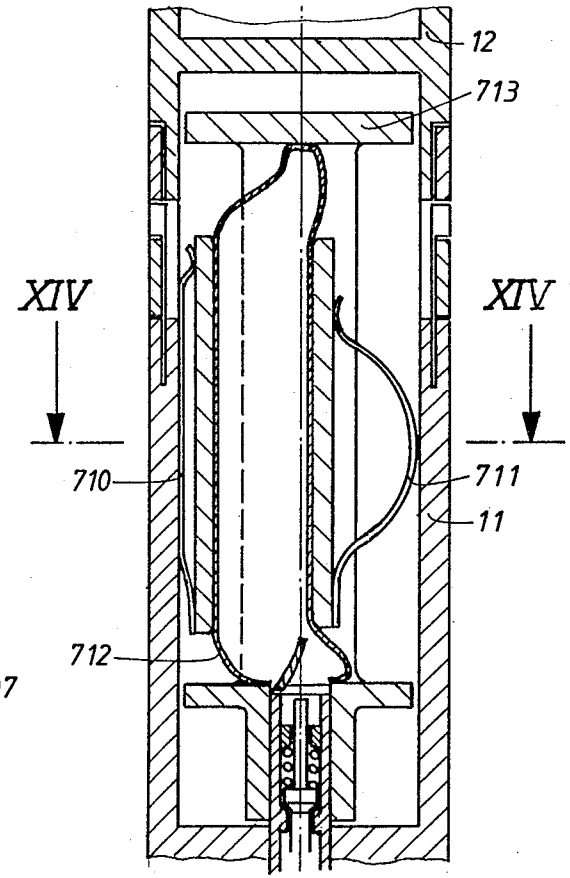
FIG. 13 is a modification of the ink or writing liquid cartridge shown in FIG. 12.
Figure 14:
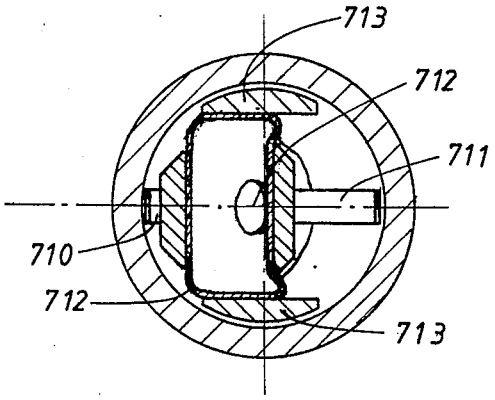
FIG. 14 is a section taken along the line XIV—XIV in FIG. 13.

Pursuant to FIGS. 13 and 14, the pressure is applied mechanically to the ink or writing fluid. The two springs 710/711 compress the ink-or writing fluid filled bag 712 which is suspended in the cartridge housing 713. FIG. 15 shows a bellows-type cartridge. The bellows 822 is compressed by the spring 821. The springs 821 or 710/711 can be located on the housing of the cartridge, or can also be attached to the receptacle 12 or to the front part 11 of the housing.

Figure 19:
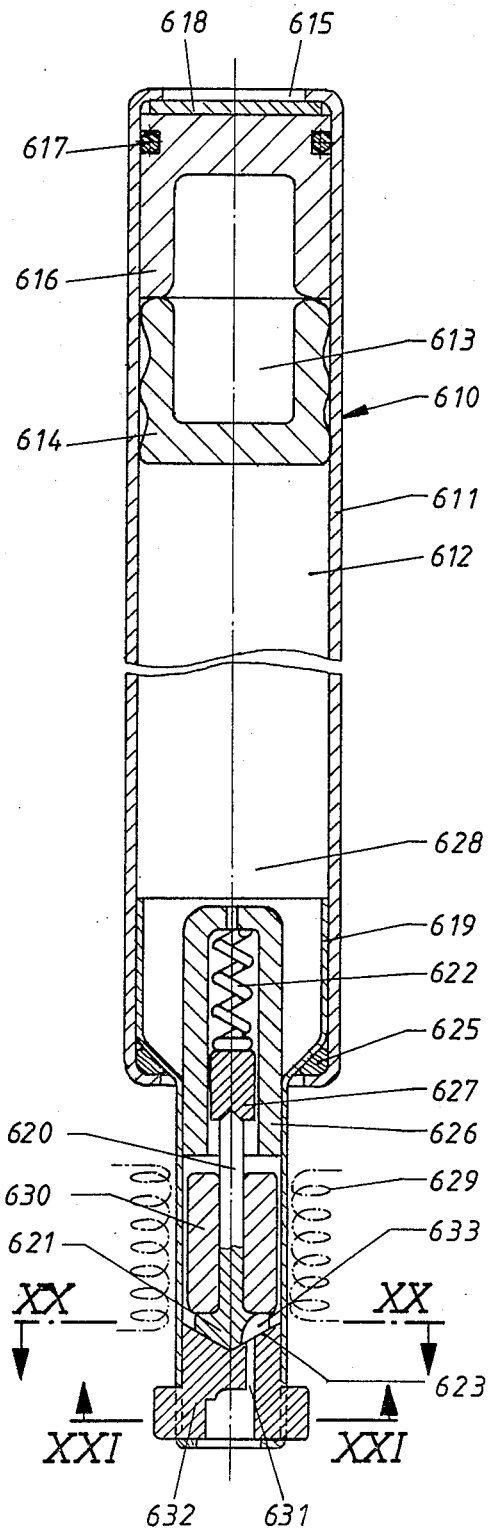
FIG. 19 is a detail of a further inventive embodiment of a writing instrument.

The vertical section of FIG. 19 shows an ink or writing fluid cartridge 610 which has a configuration similar to the cartridge 600 of FIG. 12. A metal casing 611 surrounds the actual ink or writing fluid chamber 612, the propellant gas chamber 613, and the movable piston 614 which separates the ink or writing fluid chamber 612 from the propellant gas chamber 613 and which can follow the dropping ink or writing fluid level as the ink or writing fluid is being used up. The back end face of the metal casing 611 communicates via an opening 615 with the atmosphere. A piston element 616 serves to close off the propellant gas chamber 613. This piston element 616, along with an annular seal 617, rests against the inner wall of the metal casing 611 and is held by an abutment plate 618 which engages the end flanging of the casing 611.

With the ink or writing fluid cartridges of FIGS. 13 and 15, the bottom of the ink or writing fluid chamber is closed off by a valve piston which operates in the manner of a push rod and which is pushed by a spring in its valve seat. Also in this case, i.e. the embodiment of FIG. 19, a valve body 621 which is provided with a push rod 620 is accommodated at the lower end of the ink or writing fluid cartridge 610 in a separate housing 619; the valve body 621 is pressed by a compression spring 622 against the valve seat 623. The valve arrangement 621/623 is located in the valve housing 619 which, along with an annular seal 625, is inserted in the metal casing 611. A cap-shaped abutment 626 for the compression spring 622 is located within the valve housing 619. The compression spring 622 acts on the valve push rod 620 via a spring abutment 627.

On its way to the capillary ink or writing fluid chamber, the ink or writing fluid from the ink or writing fluid chamber 612 can arrive at the valve 621/623 via the hole 628 at the spring 622, past the spring abutment 627 and the valve push rod 620.

Figure 20:
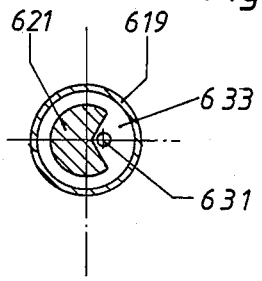
FIG. 20 is a section taken along line XX—XX in FIG. 19.
Figure 21:
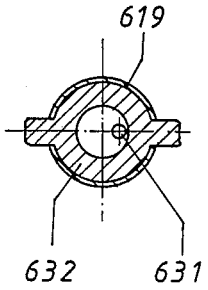
FIG. 21 is a section taken along line XXI—XXI in FIG. 19.

Although with the embodiments described up to now the auxiliary charging valve has been movable in the axial direction, with the embodiment of FIGS. 19–21, a rotary valve is provided. The aforementioned push rod 620 now forms a shaft about which the valve body 621 can turn. The rotary movement of the push rod 620 and of the valve body 621 is effected by means of an electrical induction winding 629 arranged on the outside of the valve housing 619. The induction winding 629 is controlled by the sensor with the battery which is built into the writing instrument, and can be actuated thereby in such a way that the valve body 621 turns around once by 360°. The induction winding 629 acts on a permanent magnetic rotor 630 which is nonrotatably connected with the valve push rod which serves as the shaft 620. The front end face of the valve body 621 has the shape of a flat cone which, however, as shown in FIG. 20, is interrupted over a sector of, for example, 120°. The valve seat 623 has the same conical angle in the form of a depression having a circular cone shape. However, the depression extends over the entire periphery and is only interrupted by a bore 631 which communicates with the capillary ink or writing fluid chamber in the manner already described. The valve seat 623 is located at the front end of a plug 632 which is inserted into the essentially cylindrical valve housing 619 and extends through the latter on two oppositely located sides, as shown in FIG. 21.

The ink or writing fluid cartridge with the built in valve 621/623 operates in such a manner that the valve body 621 closes off the bore 631 in the rest position (which differs from that shown in FIGS. 19 and 20). As soon as the sensor detects or signals a lack of ink or writing fluid, the induction winding 629 is excited in such a way that the permanent magnetic rotor 630 makes a complete rotation. During this rotation, the rotor 630 also passes through the position illustrated in FIG. 20, so that the ink or writing fluid from the chamber 612 can reach the bore 631. The recess 633, which can be seen in FIGS. 19 and 20 and is located at the front end face of the valve body 621, is selected with regard to the rotational speed of the rotor 630 within the ink or writing fluid fluid in such a way that the amount of ink or writing fluid required for refilling can pass. After each movement, the rotor 630 is set in such a way with known means so that one end face of the valve body 621 closes off the bore 631.

Figure 22A:
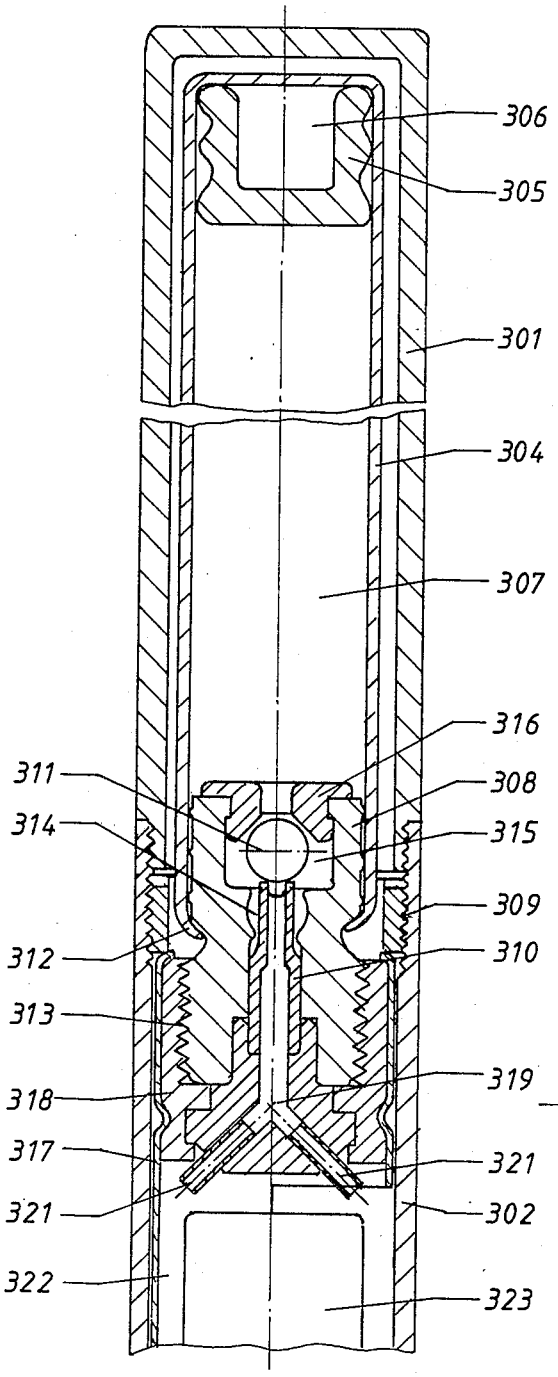
FIGS. 22*a* and 22*b* are two enlarged vertical sections through a further embodiment of the inventive writing instrument, with these two views to be placed one above the other.
Figure 22B:
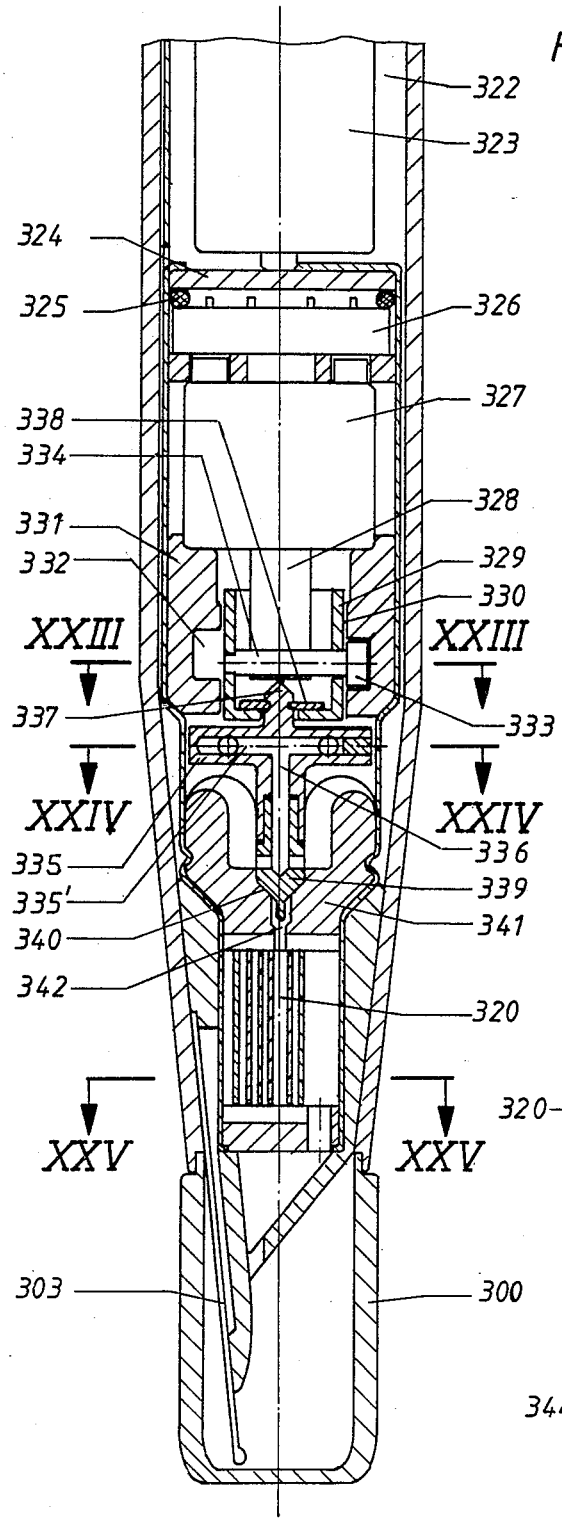

The inventive writing instrument illustrated in FIGS. 22*a* and 22*b*, which should be placed one above the other, also operates with a rotating electric motor for actuating the auxiliary charging valve, but does not operate with a lifting magnet, which experience has shown requires and utilizes considerably more electrical energy.

The writing instrument of FIGS. 22*a* and 22*b* comprises a rear casing part 301 and a front casing part 302, which at the front end is closed off in a customary manner with a cap 300 which covers the pen nib 303.

Located at the back end of the writing instrument, within the casing 301, is the ink or writing fluid cartridge 304 which is formed by a metal casing which is provided with a closed bottom. In this metal casing there is located the movable piston 305 which separates the pressurized gas chamber 306 from the ink or writing fluid chamber 307. The front end of the ink or writing fluid cartridge 304 is closed off by a valve insert 308. A suitable flanging 312 of the cartridge 304 holds the insert 308.

In order to be able to insert an ink or writing fluid cartridge into the writing instrument, the back casing part 301 is removed from the front casing part 302 at the screw threads 309. When the writing instrument is opened, the ink cartridge 304 can be screwed in with the aid of the thread 313 provided on the valve insert 308. Outside of a writing instrument, a filled ink or writing fluid cartridge, i.e. one that is under pressure, is closed off by means of the valve ball 311 which rests in the valve seat 314 of the valve insert, where it is securely held. If such a cartridge, as shown in FIG. 22*a*, is screwed into a writing instrument, the push-up tube 310, which is securely anchored in the writing instrument, pushes the closure ball 311 out of the valve seat 314. In so doing, the push-up tube 310 is not completely covered, so that the ink or writing fluid from the chamber 307 can pass the closure ball 311 and reach the interior of this tube. In order, when removing a full or not yet completely empty ink or writing fluid cartridge from a writing instrument, to prevent ink or writing fluid from being sprayed and from soiling the user, the arrangement is such that the pressure which exists in the ink or writing fluid cartridge again pushes the closure ball 311 into the valve seat 314 so as to close off the cartridge. It is necessary, however, that the ball 311 not be able to get too far from the valve set 314. For this purpose, a recess 315 is provided in the valve insert 318 for receiving the valve ball 311 when the valve is opened. In order to prevent the valve ball 311 from escaping out of the recess 315, a plug 316 is provided opposite the valve seat 314 and closes off the recess 315 to such an extent that the ball 311 cannot escape and remains in the vicinity of the valve seat 314.

As shown in FIG. 22*a*, in the upper portion of the front casing part 302 there is located an inner metal casing 317 which tightly receives the support plug 318 which is provided with the internal thread 313. This plug 318 is held by the means of flanging or beads. Within the preferably two-part plug 318 there is located the push-up tube 310 which can pass through the central bore of the valve insert of the cartridge in order to displace the valve ball 311 from its seat 314. When the valve is opened, the ink or writing fluid, through the interior of the tube 310, can reach a conduit fork 319 to which are connected helically wound steel capillary tubes 321 for the further transport of the ink or writing fluid to the capillary tube reservoir 320. As will be described subsequently, these tubes 321 also have the task of holding the auxiliary charging valve in the valve seat. Below the plug 318 there is located the chamber 322 for accommodating the dry-cell battery 323, which charges the sensor electronics and energizes the valve actuating mechanism. The electrical connection of the battery 323 can be effected in a customary manner by means of metallic housing parts or suitable leads. Below the battery chamber 322 there is located the integrated circuit, or the IC plate 326, which is separated from the chamber 322 by a separating wall 324 and is sealed off therefrom by an annular seal 325. The integrated circuit or IC plate 326 operates in the manner described previously in order to effect an actuation of the auxiliary charging valve in conformity with the control of the sensor.

Figure 23:
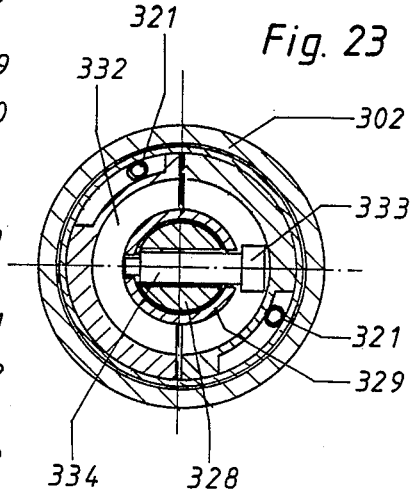
FIG. 23 is a section taken along the line XXIII—XXIII in FIG. 22*b;*
Figure 24:
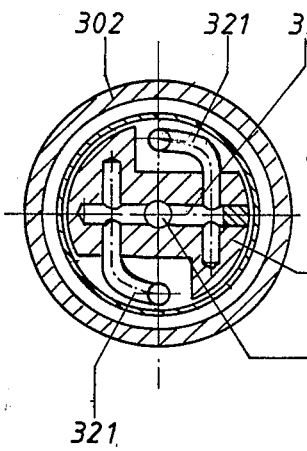
FIG. 24 is a section taken along line XXIV—XXIV in FIG. 22*b;*
Figure 25:
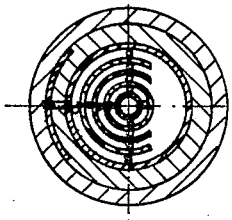
FIG. 25 is a section taken along line XXV—XXV in FIG. 22*b;*

In contrast to the previously described embodiments pursuant to FIGS. 1–18, the battery 323 of the present embodiment also serves to drive an electric motor which is located below the integrated circuit or IC plate 326. The motor shaft 328 projecting from the front of the electric motor 327 is connected with a sleeve 329 which is coaxially guided and can rotate in the bore 330 of a further housing plug 331. The plug 331 is also fixed in the aforementioned metal casing 317. A curve drive or circumferential roller conveyor 332 is provided in this plug 331 for a roller 333, the transverse shaft 334 of which is mounted in the sleeve 329. The roller conveyor 332 is guided in the axial direction in such a way that when the roller 333 has moved ahead and back in the axial direction during a complete rotation. Although the sleeve 329 is non-rotatably mounted with the motor shaft 328, it can be axially displaced, so that during a complete rotation of the roller 333, the sleeve also executes a back and forth stroke. As shown in FIG. 23, the steel capillary tubes 321, which act as springs, extend externally of the roller conveyor 332 further downwardly to the guide disc 335 which is shown in section in FIG. 24. Within the guide disc 335, the two steel capillary tubes 321 are again connected via a transverse bore 335' in order to then be able to feed an axial bore 336. The guide disc 335 is suspended by means of a peg 337 and a spring washer 338 in an opening in the bottom of the sleeve 329. The axial extension on the opposite side contains the axial bore 336 and, at the front end, the valve body 339 which, together with the valve seat 340, forms the auxiliary charging valve for the capillary chamber 320.

The helically extending steel capillary tubes 321 press the guide disc 335 downwardly, and hence push the conical valve body 339 into the conical valve seat 340, which is located in a further housing plug 341 which is also inserted into the metal casing 317. Whenever the valve 339/340 is opened, a quantity of ink or writing fluid from the chamber 307, which quantity of ink or writing fluid is ascertained in conformity with the limited cross sections, reaches the discharge bore 342 of the valve seat 340 and supplies the capillary system 320, which is connected with the pen nib 303 in a customary manner.

Hereto customary suitable controls assure that the electric motor 327 moves the roller 333 along the curved path 332 over a complete rotation, and keeps the roller 333, during a nonexcited state, in a position in which the auxiliary charging valve 339/340 is closed. The positioning and connection of the ink or writing fluid sensor is the same in this embodiment as was the case in connection with the previously described embodiments.

Figure 26:
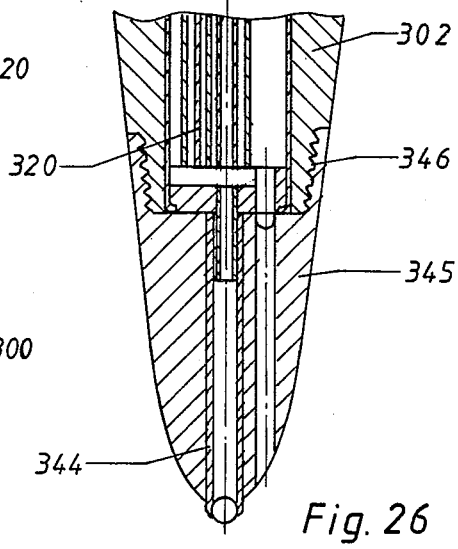
FIG. 26 is a vertical section taken through the front end of a writing instrument in which the pen nib of FIG. 22*b* has been replaced by a ball-point tip.

In the modified embodiment of FIG. 26, in place of the traditional pen nib 303, a capillary tube writing point or nib 344 is provided, the casing 345 of which is screwed onto the front end of the front casing part 302, which is provided with threads 346.

Figure 27:
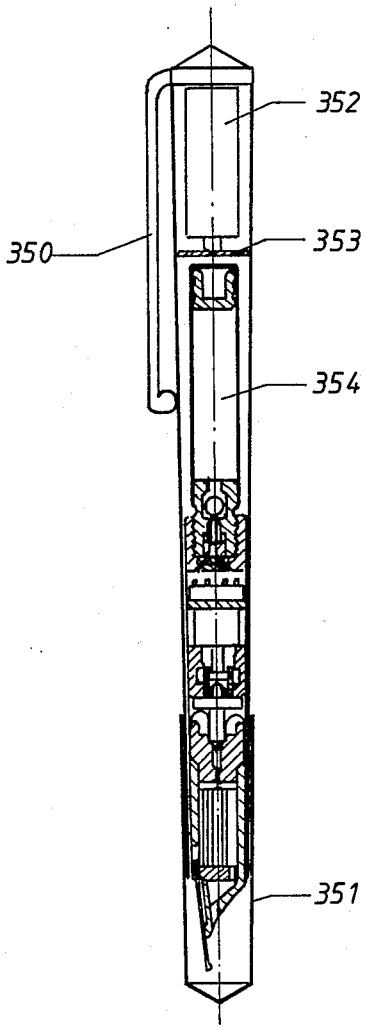
FIGS. 27 and 28 are two schematic vertical sections through two different configurations of inventive writing instruments, and are shown approximately in actual size.
Figure 28:
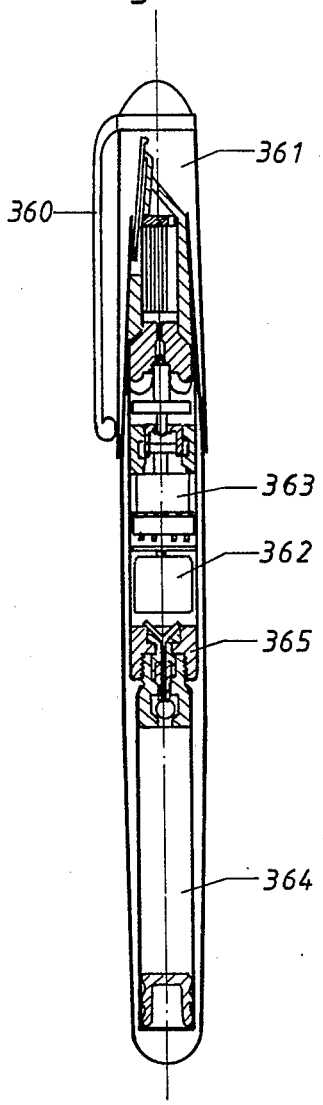

With regard to accommodating the ink or writing fluid cartridge and the dry-cell battery, FIGS. 27 and 28 show two different embodiments of an inventive writing instrument. In application and use, it is important how simply and quickly an ink or writing fluid cartridge or a battery can be replaced. Depending upon the arrangement of the ink or writing fluid cartridge and the battery, the casings of the writing instrument may have to be taken apart at appropriate locations.

In the embodiment of FIG. 27, the clip 350 is located at the back end, there of the writing instrument. At the front end is provided only a small cap 351, which surrounds the pen nib, that however cannot be placed on the back end of a fountain pen as is generally customary with such pens. In the hollow space at the back end of the writing instrument, in the vicinity of the clip 350, there is located the battery 352 which is separated from the replaceable ink or writing fluid cartridge 354 by a separating wall 353. Although the electrical connections to the battery 352 must pass the ink or writing fluid cartridge 354, this arrangement results in a shorter supply system between the ink or writing fluid reservoir and the pen nib. With this writing instrument, it must be possible to separate the casings thereof from one another in the vicinity of the thread for screwing in the cartridge. Once this casing has been dismantled into its two parts, one can first screw the ink or writing fluid cartridge 354 into the front part of the writing instrument, in order, after connecting the appropriate electrical connections, subsequently to insert a dry-cell battery 352 into the back casing; the battery 352 is held securely in its position after the two casing parts of the pen are again screwed together.

The embodiment of FIG. 27 is basically the writing instrument of FIG. 22 with the exception that the positions of the ink or writing fluid cartridge and of the dry-cell battery are reversed.

In the embodiment of FIG. 28, the clip 360 of the writing instrument is located in a customary manner on the cap 361 which covers the pen nib. With this embodiment, after taking apart the casing parts of the writing instrument, there is no difficulty in inserting a new ink or writing fluid cartridge 364, although if it comes into question, one skilled in the art must generally take into consideration replacing the battery 362 between the electric motor 363 and the ink or writing fluid cartridge seat 365. Also in this instance, the writing instrument corresponds largely to the construction of the embodiment of FIG. 22.

The present invention is, of course, in no way restricted to the specific disclosure of the specification and drawings, but encompasses any modifications within the scope of the appended claims.

What I claim is:

1. A system for supplying ink or writing liquid for a writing instrument which operates with liquid ink and has a writing element, said system in combination comprising:

a primary, permanently compressible, non-capillary, large-volume reservoir for said liquid ink that has an overpressure therewith;

a secondary, small-volume reservoir which communicates with the atmosphere and with said writing element;

an auxiliary charging valve for producing a connection between said primary and secondary reservoirs, said auxiliary charging valve being controllable as a function of need;

an electric motor which has a rotor; said auxiliary charging valve including a valve seat structurally arranged therewith, and a valve body provided with said rotor of said electric motor operable as a pump drive for conveying the liquid ink from the primary reservoir to the secondary reservoir and then to the writing element, said valve body cooperating with said valve seat, which is coaxially disposed relative thereto; said valve body being provided with a recess which communicates with said primary reservoir, and said valve seat being provided with a channel which communicates with said secondary reservoir.

2. A system combination according to claim 1, in which said rotor is a permanent magnetic rotor disposed within said writing liquid or ink of said primary reservoir, with said valve body being part of said rotor; and which includes an electromagnetic induction winding which is disposed externally of said primary reservoir and surrounds that part thereof in which said permanent magnetic rotor is disposed.

3. A system in combination according to claim 2, in which said valve body has the shape of a cone, with that end face thereof which faces said writing element being hollowed out over a limited angle; and in which said valve seat belonging therewith has a corresponding conical shape and includes said channel therein in the form of a radially outwardly displaced valve discharge bore.

4. A system in combination according to claim 3, in which said primary reservoir is in the form of an ink or writing liquid cartridge having an extension directed toward said writing element; and in which said auxiliary charging valve operates in a rotary manner within said extension of said cartridge, with said valve body thereof being pressed against said valve seat thereof as a consequence of pressure within said cartridge.

5. A system in combination according to claim 4, in which said auxiliary charging valve is provided with a spring biasing means for pressing said valve body against said valve seat.

6. A system for supplying ink for a writing instrument which operates with liquid ink and has a writing element, said system in combination comprising:

a primary, permanently compressible, non-capillary, large-volume reservoir for said liquid ink that has an overpressure therewith;

a secondary, small-volume reservoir which communicates with the atmosphere and with said writing element;

an auxiliary charging valve for producing a connection between said primary and secondary reservoirs, said auxiliary charging valve being controllable as a function of need;

said auxiliary charging valve being axially movable, and including a valve body and a valve seat; which includes an electric motor having a motor shaft; and which includes a circumferential roller conveyor by means of which, via said electric motor, said valve body being moved back and forth in the axial direction relative to said valve seat during a single rotation of said motor shaft operable as a pump drive for conveying the liquid ink from the primary reservoir to second reservoir and then to the writing element.

7. A system in combination according to claim 6, which includes helically extending steel capillary tubes which communicate with said primary reservoir and serve to supply ink or writing liquid to said auxiliary charging valve; said valve body being pressed against said valve seat by means of said steel capillary tubes in the manner of compression springs.

8. A system in combination according to claim 7, which includes a ball valve for closing off said primary reservoir, which includes a valve seat; said ball valve including a ball which is held against said valve seat by means of pressure in said primary reservoir; and in which said primary reservoir also includes an abutment at a slight distance from said valve seat; said abutment, in the opened state of said ball valve, not hindering flow of ink or writing liquid and retaining said valve ball in the vicinity of said valve seat.

9. A system in combination according to claim 8, in which said valve seat is yielding in order to hold said valve ball tightly and positively until said ball valve is opened.

* * * * *